US005184885A

United States Patent [19]

Arabian et al.

[11] Patent Number: 5,184,885

[45] Date of Patent: Feb. 9, 1993

[54] CLOTH TOWEL DISPENSER WITH TWO ADJOINING UNITS

[75] Inventors: Sandro Arabian, Vaduz/Liechtenstein; Manfred Baumann, Diepoldsau, both of Switzerland

[73] Assignee: CWS International AG, Baar, Switzerland

[21] Appl. No.: 884,478

[22] Filed: May 12, 1992

Related U.S. Application Data

[63] Continuation of Ser. No. 598,683, Nov. 26, 1990, abandoned.

[30] Foreign Application Priority Data

Feb. 14, 1989 [CH] Switzerland ..... 505/89-0

[51] Int. Cl.[5] ..... B65H 19/00

[52] U.S. Cl. ..... 312/34.11; 312/34.12

[58] Field of Search ..... 312/34.11, 34.12, 34.13

[56] References Cited

U.S. PATENT DOCUMENTS 1,470,944 10/1923 Steiner ..... 312/38

1,756,839 4/1930 Steiner et al. ..... 312/38

2,103,403 12/1937 Birr ..... 312/34.11

4,746,907 5/1988 Behnder, Jr. ..... 312/34.11

*Primary Examiner*—Victor N. Sakran

*Attorney, Agent, or Firm*—Egli International

[57] ABSTRACT

The cloth towel dispenser appropriately comprises two towel units, whereof each unit is independently completely operational. The cloth towel (7) is guided over a delivery roller (20) into a draw-in roller (25). On pulling out the towel (7) for forming a towel loop (8), the delivery roller (20) is also rotated, as is the draw-in roller (25) via an envelope drive (32). In the draw-in shaft (30) is located a spring tension accumulator (36), which is tensioned on pulling out. By means of a cam wheel (43) and a catch (44), the length of the towel which can be pulled out is limited. As also a part of the used towel wound from the draw-in roller (25) can be retracted, the length of the clean towel to be pulled out can be kept smaller. After a certain interval a timer releases the catch (44), so that the spring tension accumulator rotates the draw-in roller (25) and the cloth loop (8) is wound up.

5 Claims, 6 Drawing Sheets

28
29
33
69
56'
57'
52
56
57
53
55
32
35
54
70
64
58
59
61
60
68'
63
62
34
30
66
67
85
68
65
10

28
43
39
71
29
40
69
38
44
72
74
75
76
93'
73
77
91
94
78
50
92
93
48
83
89
88
63
30
104
84
86
68
85
87
67
66
80

CLOTH TOWEL DISPENSER WITH TWO ADJOINING UNITS

This is a continuation of co-pending application Ser. No. 07/598,683, filed on Nov. 26, 1990 now abandoned.

BACKGROUND AND OBJECTS OF THE INVENTION

1. Field of the Invention

The invention relates to a cloth towel dispenser with two adjoining towel units, whereof each towel unit has a casing with a cover, a delivery point with a delivery roller for receiving and for the portionwise unrolling of a clean towel roll and a draw-in point with a draw-in roller for drawing in and winding up the used towel part to form a roll and usable for drying the hands by manually pulling out a towel loop, the delivery roller being connected with the draw-in roller by means of a gear and on the underside of the casing is located an indicator flap pivotably mounted in the casing side walls and which in the visible position indicates that the towel unit is ready to use.

2. Description of Related Art

Towel dispensers in which a cloth portion is made available for drying the hands are known in numerous different constructions. In most towel dispensers the user draws a cloth portion out of the dispenser so that he can dry his hands. The cloth towel is a strip of finite length available for a certain number of uses and which must then be replaced. To be able to bridge the resulting interruption in use, it is known from the Applicant's EP-A-0 283 554 to use a cloth towel dispenser comprising two adjoining or abutting towel units. The two towel units of this so-called twin dispenser are constructed precisely identically. The cloth towel thereof is passed by means of a delivery roller onto a draw off roller. On pulling out the cloth for forming a towel loop the draw-in roller is also rotated by means of an envelope drive or gear. The draw-in roller contains a spring tension accumulator, which is drawn up during each towel loop formation. The length of the towel which can be drawn out is limited by a catch. Following the drawing out of a towel loop and at the end of a certain period of time the spring tension accumulator rotates the draw-in roller and consequently winds the towel loop onto the same, so that the used loop disappears. This known twin dispenser functions reliably. As soon as the cloth towel of one towel unit is used up, the second towel unit is freed for operation, in that its signal or indicator flap is pivoted into the visible position. The towel unit with the used cloth towel can be replaced during the operation of the second towel unit and made available in such a way that when the towel in the second towel unit has been used, the first towel unit is ready to operate again.

To ensure that the cloth towel of a towel unit is completely used, it is known to block the next towel unit to go into operation and to only free it when the towel in the operating unit has been completely used. When towel users appear in quick succession, it is unavoidable that one of the waiting people will attempt to use the blocked towel unit. However, the force which is exerted leads to a problem and consequently said towel unit fails.

Therefore the problem of the present invention is to avoid the risk of a fault of the towel unit not in operation in that although a use thereof is possible, this is not indicated.

SUMMARY OF THE INVENTION

According to the invention this problem is solved in that during the readiness for use of one towel unit, a towel loop can be pulled out for use from the other towel unit provided with a towel, although in the case of the latter the indicator flap is not in the visible position and is only pivoted into the latter when the towel of the first towel unit has been used and rolled onto the draw-in roller.

BRIEF DESCRIPTION OF THE DRAWINGS

The invention is described in greater detail hereinafter relative to a non-limitative embodiment and the attached drawings, wherein show.

DETAILED DESCRIPTION OF PREFERRED EMBODIMENTS

Figure 1:
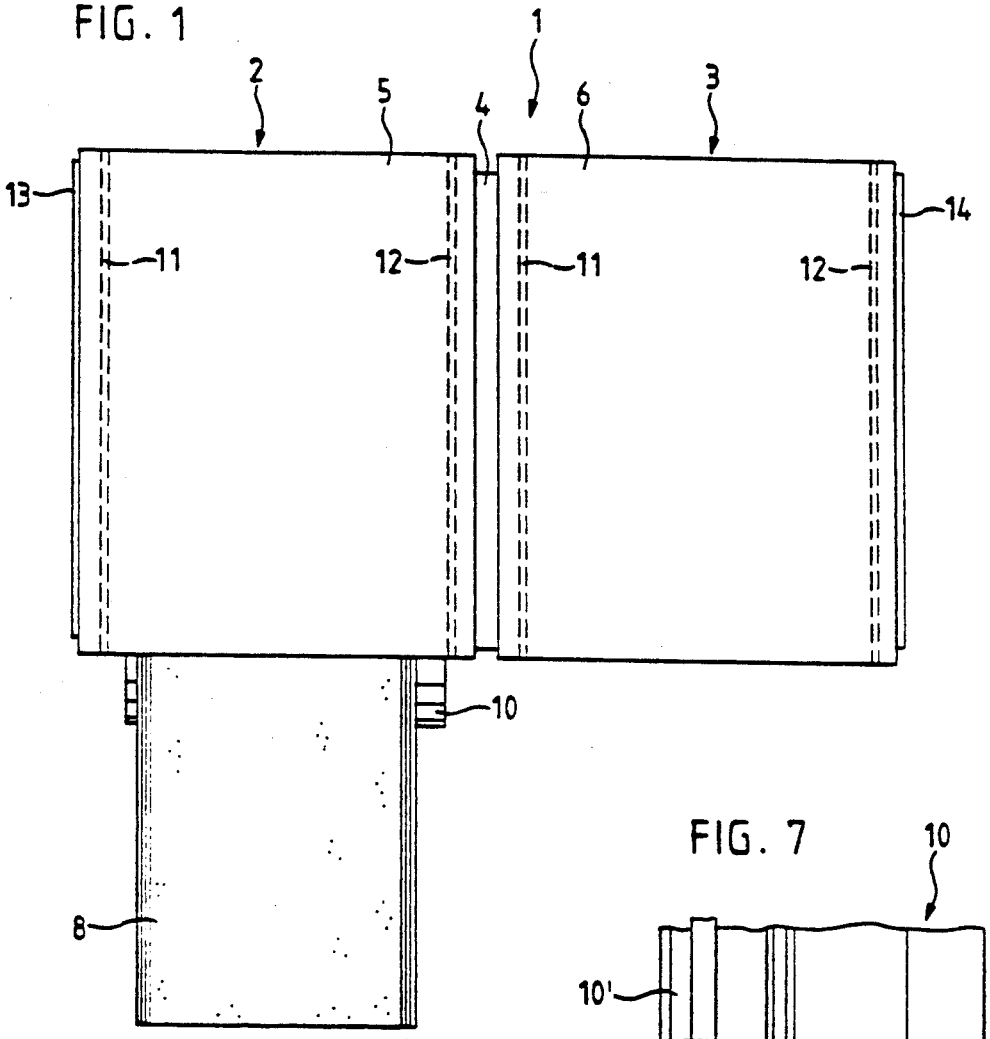
FIG. 1 A front view of a towel dispenser with two towel units, one towel unit being in operation and the other towel unit ready to operate.

The twin dispenser 1 shown in FIG. 1 has two juxtaposed towel units 2, 3 between which is provided a narrow transition frame 4. The towel unit 2, 3 is essentially a parallelepipedic body whereof, viewed from the side, it is only possible to see the cover 5, 6 covering the casing behind it.

The towel unit 2 is in operation and is shown with a cloth towel loop 8 pulled out on the underside of said unit and which can be used for drying the hands. It is also possible to see on the underside a signal or indicator flap 10, which in the represented visible position permits the pulling out of the clean towel and when the cloth reserve is used up indicates that refilling is necessary.

Casing walls 11, 12 are indicated in broken line form in the covers 5, 6 and within these the cloth transport takes place and the loop 8 is formed. Between the casing walls 11, 12 and the outer covers 13, 14 there is consequently a narrow space housing all the drive and control components.

Figure 2:
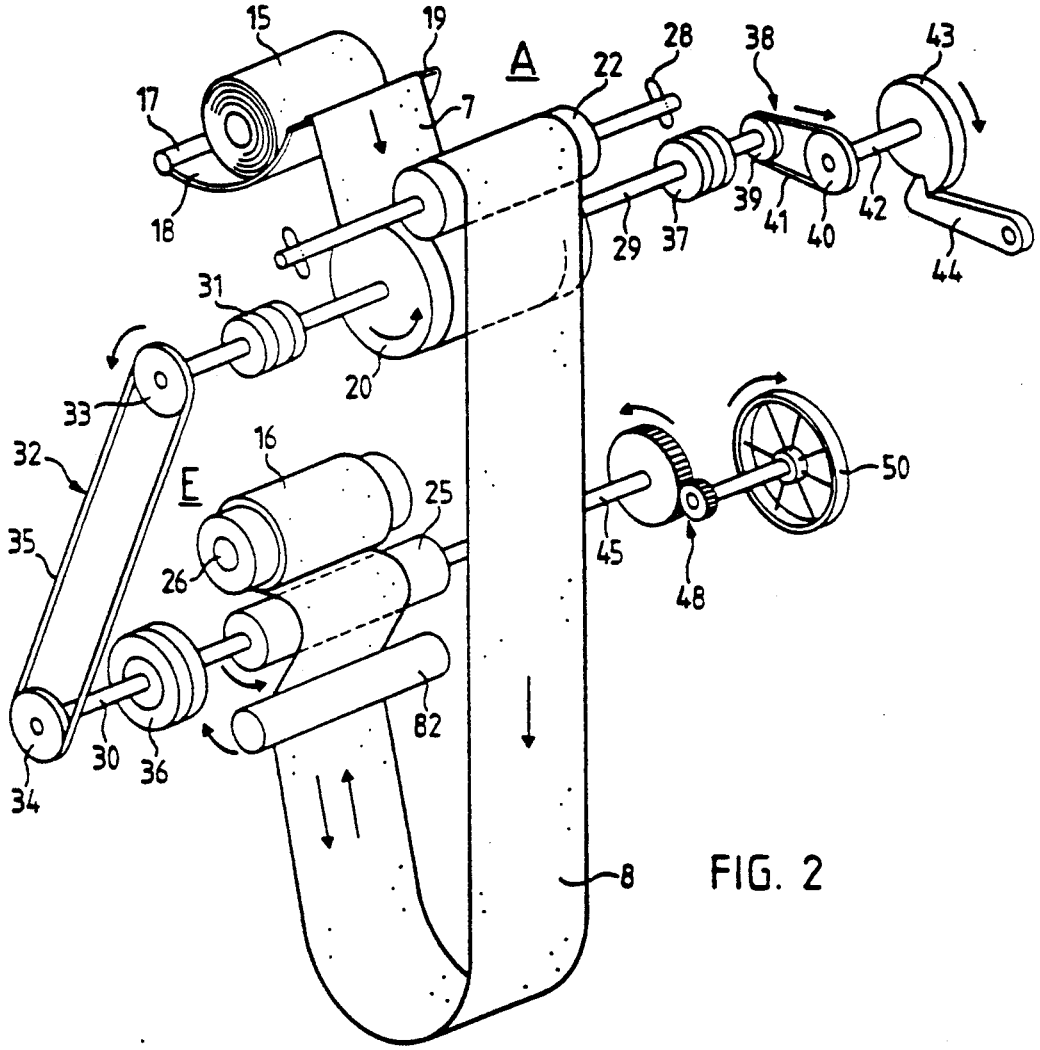
FIG. 2 A diagrammatic view of the essential inner parts of a towel unit in a three-dimensonal view.

In FIG. 2 A is a delivery point for receiving a clean towel roll 15 and E is a draw-in point located below the delivery point A for receiving and rolling up the used or spent towel roll 16. The clean towel roll 15 is located in a roll tray 18 pivotable about a spindle 17 and which is drawn upwards by not shown spring tension to the extend that this is allowed by the roll 15. The cloth towel 7 delivered by the roll 15 is guided over the free edge 19 of the roll tray 18 around a delivery roller 20 provided with a rough circumference and then over a pressure roller 22. The towel 7 within the cover then extends downwards to the indicator flap 10 (not shown in FIG. 2) and then upwards to the draw-in point E. The hands are dried after pulling out the loop 8. For inserting the roll 15 the tray 18 can be drawn downwards by means of a handle 105 (cf. FIG. 9).

In the draw-in point E the used cloth towel is guided by means of a draw-in roller 25, which is also provided with a rough surface and on which the used towel roll 16 is wound on a mandrel 26, which is guided in a guide groove 70 located in the casing walls 11, 12 and can consequently give way in accordance with the increasing diameter of the roll 16.

The pressure roller 22 in the delivery point A is guided in guide slots 28. As a result of the guidance of the towel the delivery roller 20 is pressed on forming the loop 8 and reliably rotated.

The delivery roller 20 is fixed to a delivery shaft 29 and the draw-in roller 25 to a draw-in shaft 30. The delivery roller 29 drives via a slip clutch 31 an envelope drive 32, which comprises a driving gear 33, a driven gear 34 and an envelope member 35, e.g. a toothed belt, the driven gear 34 being fixed to the draw-in shaft 30. The latter is connected by means of a spring tension accumulator 36 to the draw-in roller 35. It would also be conceivable to place the slip clutch 31 on the draw-in shaft 30 instead of on the delivery shaft 29.

At the other end of the deliver roller 20 the delivery shaft 29 drives the envelope drive 38 by means of a slip clutch 37, said drive comprising a driving pinion 39, a driven gear 40 and an envelope member 41. The driven gear 40 is located on a shaft 42 with a cam disk 43, which cooperates with a retaining catch 44. The cam disk 43 and the retaining catch 44 limit the length of towel which can be drawn out on pulling the towel 7 for forming the loop 8. The release of the retaining catch 44 is brought about by a timer, as will be explained with the aid of FIG. 4.

On the side of the draw-in roller 25 remote from the spring tension accumulator 36 is connected a draw-in shaft part 45 with a multistage gear 48 (only one stage is shown), by means of which a brake wheel 50 is driven at very high speed. The function of the brake wheel 50 is to prevent the relaxing of the spring tension accumulator 36 when the towel unit is open and to block the draw-in shaft 30 on switching on the timer.

Figure 3:
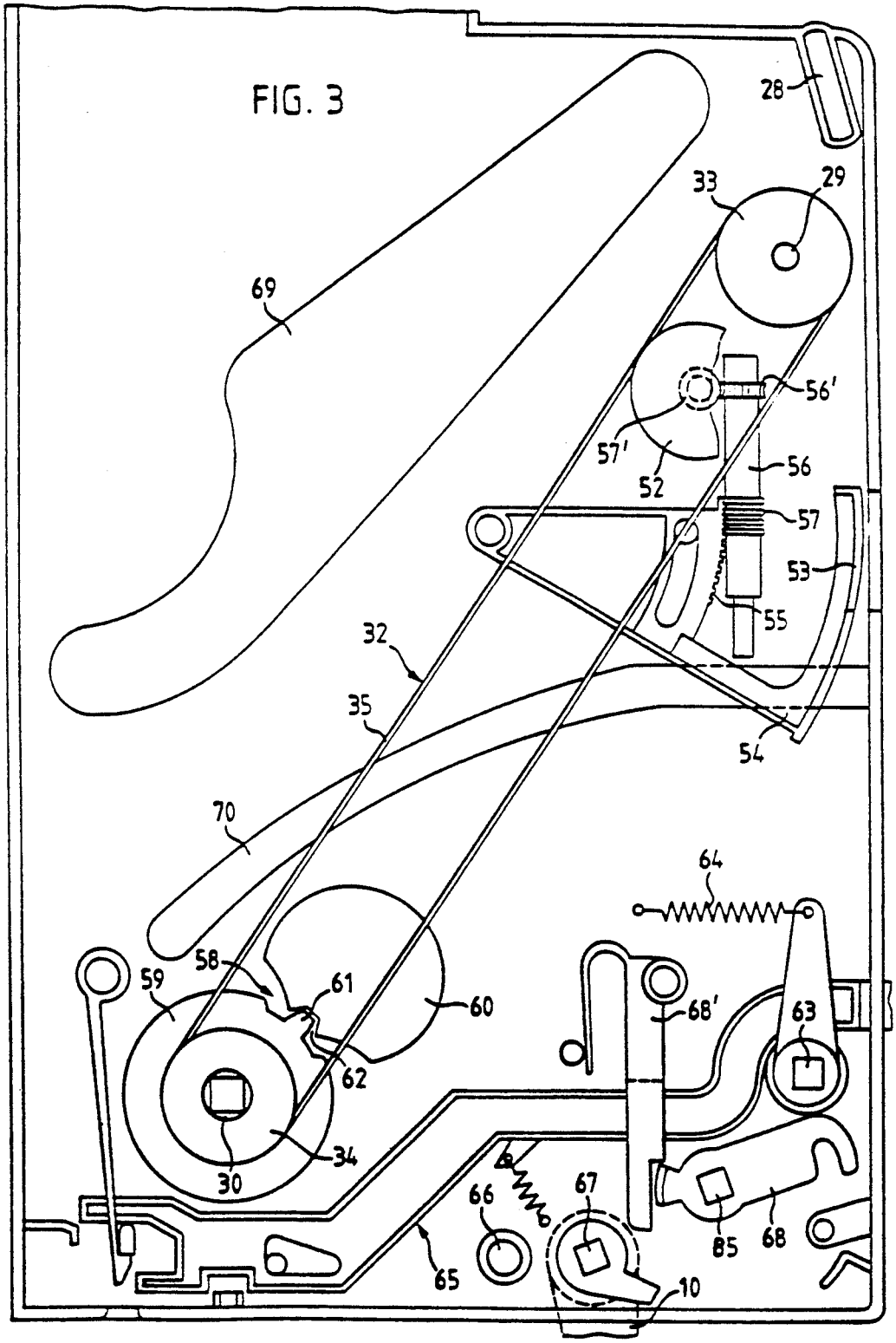
FIG. 3 A view of the left-hand side wall, seen from the front, of a towel unit with the side cover removed.

FIG. 3 shows an external view of the casing wall 11. The reference numerals coinciding with those of FIG. 1 indicate the same parts.

The envelope drive 32 and an intermediate gear 52, which is part of a towel supply indicator 53 extend roughly diagonally. The arm 54 connected to the supply indicator 53 has a tooth system 55, which cooperates with a worm 57 fixed to a shaft 56. Shaft 56 is connected by means of a further worm gear 56', 57' to the intermediate gear 52. As soon as the towel is pulled out for forming a loop 8, there is also an adjustment of the supply indicator 53. With the driven gear 34 on the draw-in shaft 30 is associated a locking mechanism 58 with two disks 59, 60 having a Maltese cross-like engagement and whose disk 59 has a cam 61 and whose disk 60 has a groove 62.

Figure 9:
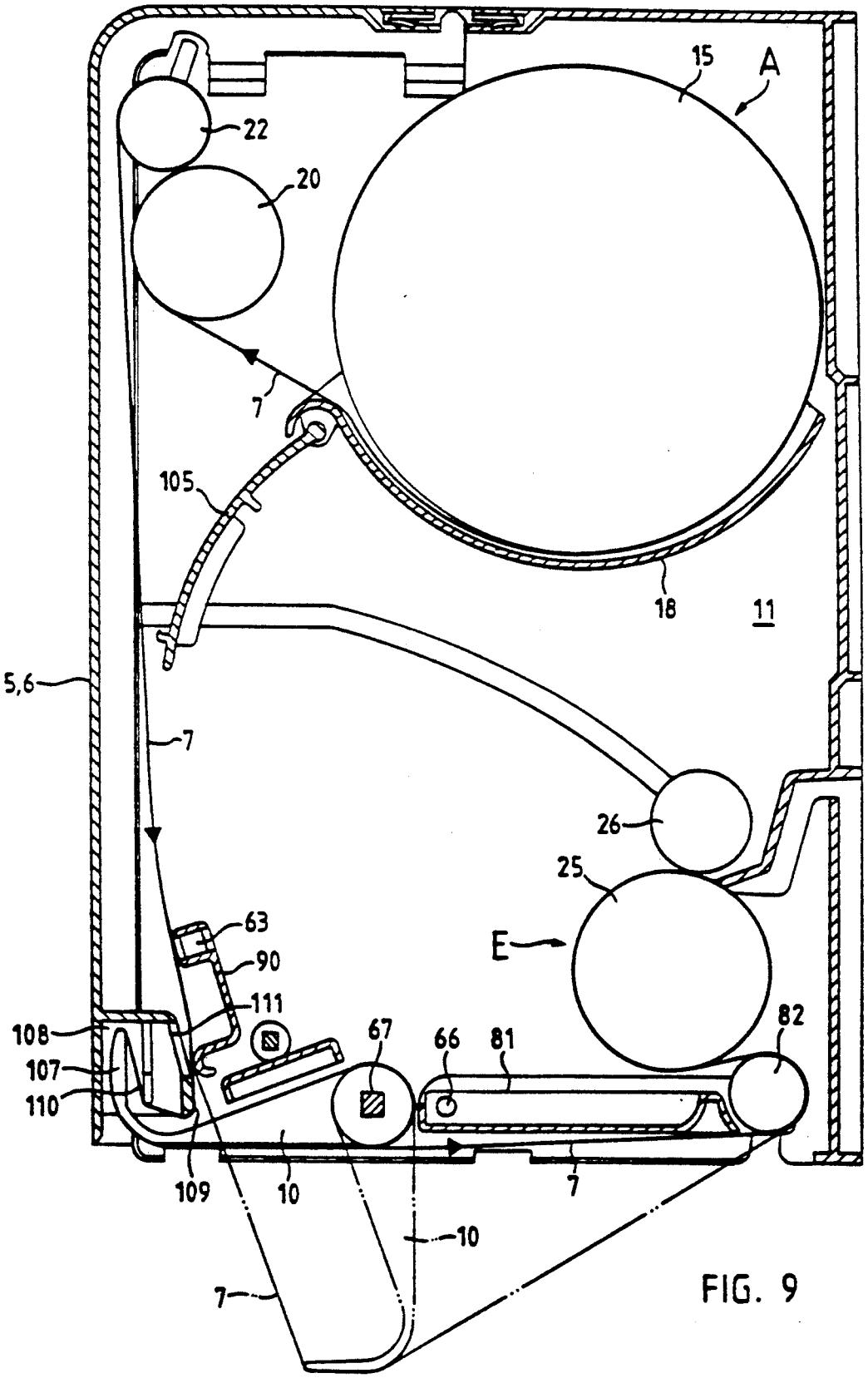
FIG. 9 A vertical section through a towel unit.

A shaft 63, cf. also FIG. 9, which is tensioned by a spring 64 traverses the casing and has a sensing rake 90 for establishing the presence of towel material. The towel 7 runs between the sensing rake 90 and a comb-like web 109 located on cover 5, 6 and extends further around the indicator flap 10 (FIG. 1).

65 is a locking rod, which frees a bottom flap 81 on opening the cover (cf. FIGS. 5 and 6) and whose pin 66 is located alongside the pivot pin 67 of the signal flap 10. The locking rod 65 prevents the closure of the towel unit. If the cover 5, 6 is closed, firstly the bottom flap 81 must be reengaged, the cover 5, 6 pressed against the casing and a locking hook 68 pivoted into the closed position by a not shown key, the locking hook cooperating with a pawl 68'.

The reference numerals 69, 70 designate protuberances in the casing wall 11 and which appear on the inside as depressions for housing the spring system of the roll tray 18 or for guiding the mandrel 26 in the draw-in point E.

Figure 4:
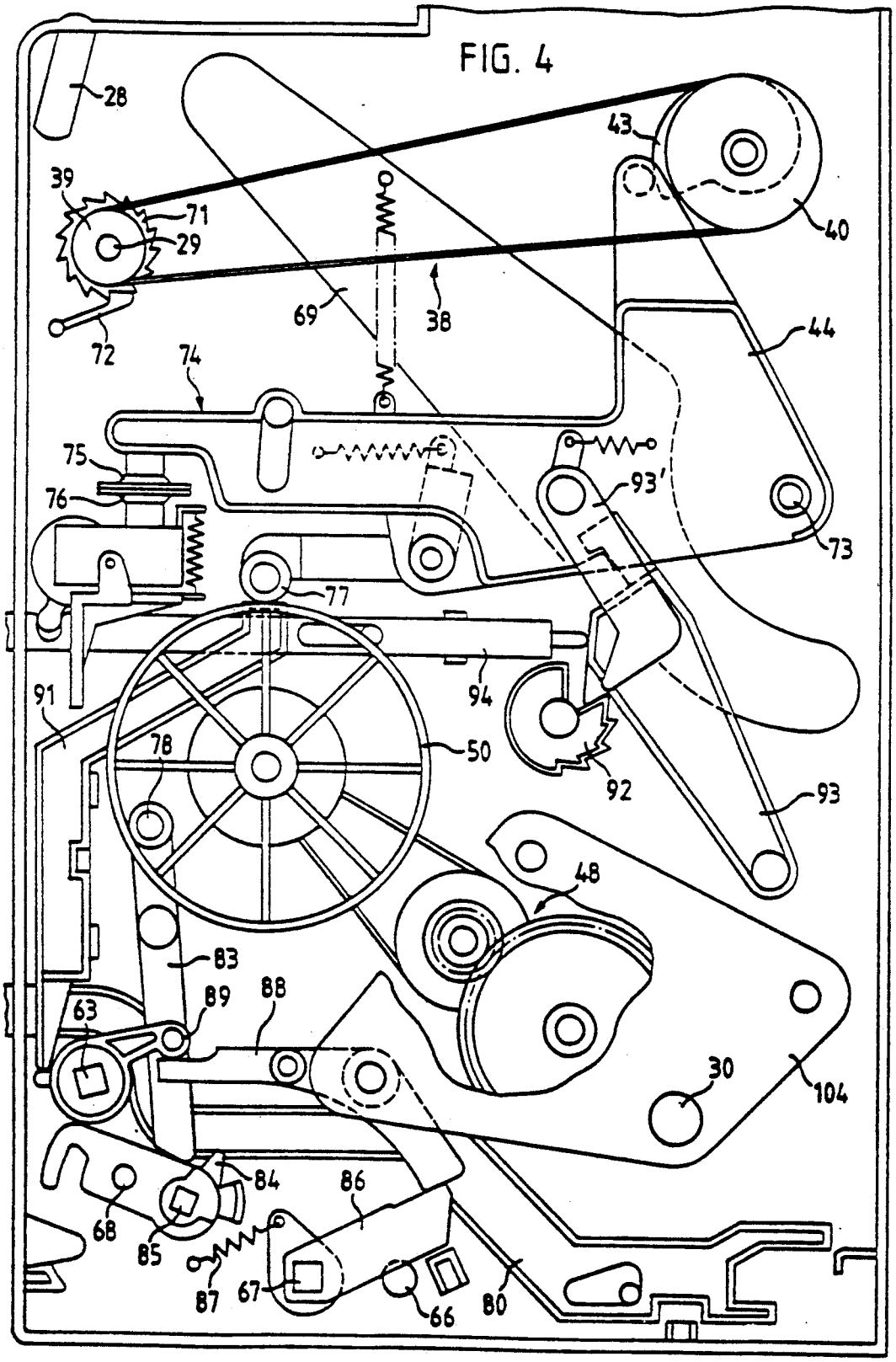
FIG. 4 A view of the right-hand side wall of a towel unit with the side cover removed.

FIG. 4 is an outside view of the casing wall 12. On the delivery shaft 29 is located a pawl wheel 71, which prevents the turning back of the delivery shaft 29 by cooperation with a resilient catch 72. The driving pinion 39 of the envelope drive 38 is also located on the shaft 29, being connected by means of the slip clutch 37. The driving pinion 39 drives the driven gear 40 on whose spindle is located the cam disk 43. A catch 44 in operative connection with the cam disk 43 constitutes part of a pivot arm 74 pivotable about a shaft 73, which carries a suction cap 75 and a braking roller 77. On pulling out the towel 7 for forming the loop 8, the suction cup 75 is pressed by the cam disk 43 onto a suction cup 76 and simultaneously the braking wheel 50 and therefore the drawing in of the towel is blocked by the braking roller 77. At the end of the set time separation occurs between the suction cup 75 and a further suction cup 76, so that the braking wheel 50 is freed from the action of the braking roller 77. The cam disk 43 is set free, so that through the spring tension accumulator 36 in the draw-in shaft 30 the drawing in of the pulled out loop 8 commences. The drawing in of the loop 8 is accompanied by the putting into action of the multistage gear 48 by the draw-in shaft 30 and the braking wheel 50 is raised. During the pressing together of the suction cups 75, 76 the braking roller 77 presses on the braking wheel 50 and prevents any movement of the draw-in shaft 30.

If the cover 5, 6 is opened, a second braking roller 78 engages on the braking wheel 50 and prevents the rotation of the draw-in roller 25 and therefore the running down of the spring tension accumulator 65. The braking roller 78 is located over a locking rod 80 corresponding to the locking rod 65 on the wall 11 and with which the bottom flap 81 pivotable about the spindle 66 is locked and when the cover 5, 6 is opened the closure thereof is prevented. The braking roller 78 is mounted on a pivot lever 83, which projects into the vicinity of the locking shaft 85 carrying the locking hook 68 and is controlled by a cam 84 positioned on said shaft.

Figure 5:
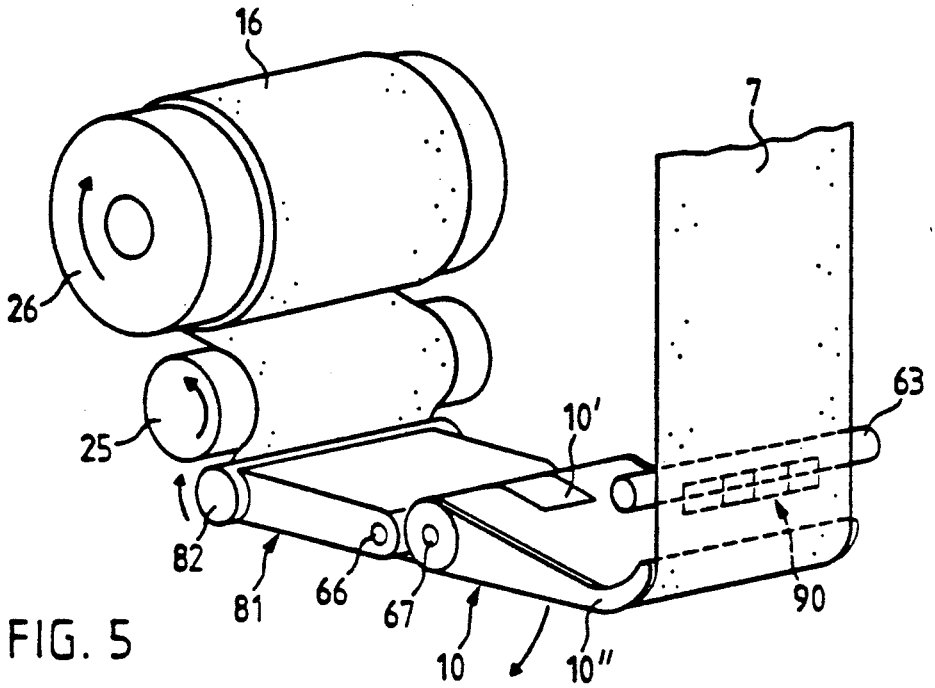
FIG. 5 A diagrammatic view of the draw-in point of a towel unit with an indicator flap and a bottom flap in a three-dimensional view.
Figure 6:
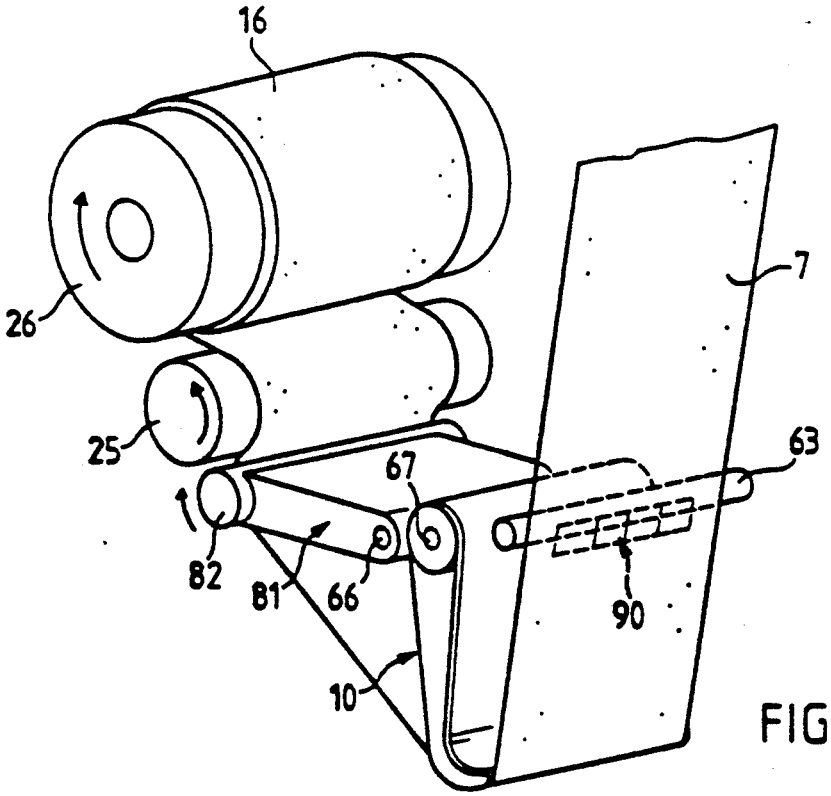
FIG. 6 The draw-in point according to FIG. 5 with the indicator flap pivoted into the visible position to indicate the readiness for use.

FIGS. 5 and 6 show the function of the indicator flap 10 and the bottom flap 81 pivotable about the spindle 66 and located behind the same. On its free end the bottom flap 81 has a rotary roller 82 about which is passed the used towel 7. The bottom flap 81 is kept in its operating position by the locking rods 65, 80. As soon as the cover 5, 6 is opened, the bottom flap 81 is unlocked in the vicinity of the rotary roller 82. The locking rods 65, 80 move somewhat in the direction of the cover, which can only be closed again when the rotary roller 82 has brought the bottom flap 81 into its operating position.

In FIG. 5 the indicator flap 10 forms part of the bottom and is therefore not visible. However, it means that the cloth towel unit 3, cf. FIG. 1, is ready to operate, but the indicator flap 10 only pivots into the position shown in FIG. 6 when the towel 7 of the towel unit has been used up. The signal flap 10 is in two parts, cf. FIGS. 7 and 8, with one part 10' being fixed and the other part 10" pivotably mounted on the shaft 67. The shaft 67 has a lever 86 (FIG. 4), which is kept in position by a two-arm lever 88 in which a spring 87 exerts a pivoting force on the lever 86. The two-arm lever 88 is in operative connection with a lever 89 fixed to the sensor shaft 63.

FIGS. 5 and 6 show the sensor shaft 63 with a sensor rake 90. For as long as the towel 7 covers the sensor rake 90, the lever 89 has a position such that the two-arm lever 88 keeps the lever 86 of the indicator flap shaft 67 in the tensioned position. As soon as the end of the towel 7 has passed the sensor rake 90, under the action of spring 64, cf. FIG. 3, the sensor shaft 63 is pivoted with the sensor rake 90 against the cover 5, 6, on which is located a web 109 with recesses 111 for the passage of the bars of the sensor rake 90. Therefore the two-arm lever 88 is pivoted by the lever 89, so that the lever 86 brings about a counterclockwise pivoting of the indicator flap shaft 67. This pivoting movement is utilized in order to bring into the operating position the adjacent cloth towel unit 3 from the readiness position shown in FIG. 5 by swinging out the indicator flap 10. This can be brought about in a simple manner by a square tube, which is located at the end of the indicator flap shaft 67 and is engaged on a square end of the indicator flap shaft of the adjacent towel unit. There is no need for any further connection to the towel unit 3.

Both the towel unit 2 and the towel unit 3 can be operated individually. It is merely necessary to use the relevant cover. Only in the case of a joint arrangement do these covers have to be replaced by the transition frame 4 and simultaneously the two indicator flap shafts 67 are interconnected by the connecting tube. On pivoting out the sensor shaft 63, in addition a push rod 91 is raised through which the braking roller 77 is raised, so that the braking wheel 50 can be put into motion by the spring tension accumulator 36, so that the towel end is drawn into the draw-in point.

An aid when inserting a clean towel is provided in the form of a pawl wheel 92 roughly in the centre of the casing wall 12 shown in FIG. 4, a spring-loaded catch 93 cooperating with the pawl wheel 92 and a push rod 94. On opening the cover the push rod 94 is moved forwards, so that the catch 93 engages in the pawl wheel 92. If the start of the new cloth strip is placed over the delivery roller 60 and the strip pulled out in order to place the end around the mandrel 26 of the draw-in point E, the cam disk 43 is also rotated. During each rotation it moves the pivot arm 74, so that the catch 93 is removed from the pawl wheel 92 and the latter is rotated by one tooth by a further catch 93'. After passing through the e.g. five teeth, the catch 93 blocks the pivot arm 74, cf. FIG. 4. The unwound cloth length is sufficient for inserting the start of the strip around the mandrel 26 and consequently need not be measured. If further rotation takes place by force, the slip clutch 37 comes into action and prevents faults or problems on the dispenser. Thus, this means not only facilitates the insertion of a clean towel, but prevents damage to the dispenser by incorrect insertion or the use of force. Reference should also be made to the description of EP-A-0 283 554 with details concerning the draw-in roller 25.

On the right-hand side of the draw-in roller 25, i.e. in the vicinity of the casing wall 12, it is possible to see part of the multistage gear 48 by means of which the braking wheel 50 is driven. The gear 48 is provided with a covering 104, which has partly been omitted in FIG. 4.

Figure 7:
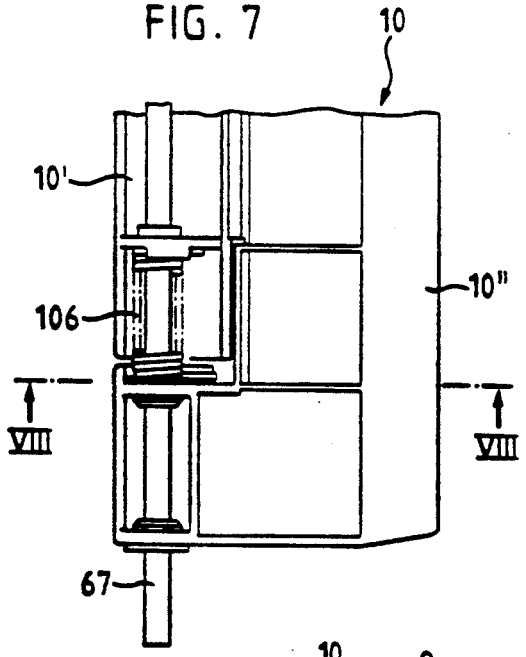
FIG. 7 A plan view of the partly shown, two-part signal flap, which is kept in its extended position by a torsion spring.
Figure 8:
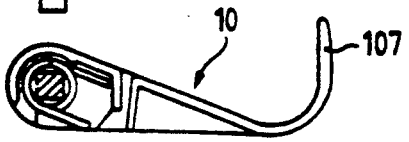
FIG. 8 A vertical section through the indicator flap according to FIG. 7.

It is important that the indicator flap 10 indicates the readiness to operate of the towel units 2, 3 or the end of the drawing of cloth onto the draw-in roller 25, substantially independently of the remaining functions of the twin dispenser. If one cloth towel unit is in operation, the indicator flap is in the visible position. For the other towel unit the indicator flap 10 is in the invisible position, cf. the towel unit 3 in FIG. 1, but is still ready to operate. It is important that it is also possible to use the towel unit in this state, although the indicator flap 10 is not visible. The indicator flap 10 pivoted out in the case of towel unit 2 draws the attention of the user to the fact that the towel unit with the visible indicator flap should be used. Thus, the towel unit with the indicator flap which is not swung out remains in reserve, but can be used at any time, e.g. when there is a surge of prospective users. If the towel 7 has become completely used up on the towel unit with the visible indicator flap 10, then the sensor shaft 63 pivots against the cover 5, so that the flap 10 is freed from the two-arm lever 88 and consequently can be pivoted into the visible position. The cloth towel on the towel unit where the towel has been used up can now be changed and the unit made ready to operate again, i.e. with the indicator flap 10 in the invisible position. Due to the fact that the pulling out of the towel can take place independently of the indication by the indicator flap 10, there is a simplification to the control on the one hand and on the other it is easier to control the situation when there is a surge of users. FIGS. 7 to 9 illustrate the special construction of the indicator flap 10, which is necessary on the one hand to ensure the clean drawing in of the used towel into the draw-in roller 25 and on the other to permit a reliable pivoting out of the indicator flap 10 into the visible position.

It is apparent from FIGS. 7 and 8, that the indicator flap 10 comprises two flap parts 10', 10". The flap part 10' is fixed to the sensor shaft 67, whilst the flap part 10" is pivotable on said shaft 67. The pivotable flap part 10" is coupled to the fixed flap part by a torsion spring 106, but can also be pivoted by expending a certain force. Thus, the indicator flap still remains functional if force is used to attempt to operate the towel unit. FIG. 8 shows that the indicator flap 10 has an upwardly curved, angled marginal web 107. As can be gathered from FIG. 9, the web 107 projects into a cavity 108 formed on the cover 5, 6 and on which are also provided the recesses 111 for the passage of the bars of the sensor shaft 63. The cloth towel 7 moves between the recesses 111 and the bars of the sensor shaft 63, as shown in FIG. 9. It is important that when the indicator flap 10 is in the invisible position, the towel 7 is carried along by the marginal web 107 and a loop 110 is formed in the cavity 108. Also when the used towel portion has been drawn into the draw-in roller 27 and is therefore no longer visible, the loop 110 created by the edge 107 forms a material reserve, as a result of which the indicator flap 10 can be pivoted into the visible position, cf. FIG. 9. This on the one hand ensures the clean appearance of the towel unit and on the other still ensures a reliable pivoting of the indicator flap 10 into the visible position. FIG. 9 also shows the path of the cloth towel 7, as has been described in conjunction with FIG. 2.

The described twin dispenser 1 is able to ensure an uninterrupted towel service. However, it is still possible to use both towel units should this prove necessary, but only one indicator flap 10 pivots into the visible position. Therefore, in normal operation, it is ensured that firstly one towel unit is used and then when cloth stops passing through the indicator flap 10 pivots in the adjacent towel unit, in that the aforementioned locking of the lever 86 is released on pivoting the sensor shaft 63.

We claim:

1. A cloth towel dispenser having at least two towel units within said dispenser, each capable of simultaneously dispensing a cloth towel on demand, each towel unit comprising:

delivery means for delivery on demand of clean towel portions from a clean towel roll;

roller means for drawing in used towel portions after use;

determining means for determining when the clean towel roll is empty; and indicator means for indicating that one towel unit is ready for use when another towel unit is empty, the indicator means of the one towel unit cooperating with the indicator means of said another towel unit to provide the indication of readiness for use of the one towel unit.

2. A cloth towel dispenser according to claim 1, wherein the indicator means comprises an indicator flap pivotally connected to the towel unit, and which is in an invisible position when the towel unit is not ready for use and in a visible position when the towel unit is ready for use.

3. A cloth towel dispenser according to claim 2, wherein the indicator flap has two parts, the first part being fixed to a pivoting shaft and the second part being non-positively connected to the first part with a torsion spring.

4. A cloth towel dispenser according to claim 3, wherein the second part of the indicator flap includes an upwardly bent marginal web portion.

5. A cloth towel dispenser according to claim 4, wherein when the indicator flap is in the invisible position the indicator flap projects into a cavity a forms a clean cloth towel reserve loop, the clean cloth towel reserve loop being used for displaying a clean towel portion when the indicator flap moves into the visible position.

* * * * *